US006893517B2

(12) United States Patent
Zeuner et al.

(10) Patent No.: US 6,893,517 B2
(45) Date of Patent: May 17, 2005

(54) NITROCELLULOSE-FREE GAS-GENERATING COMPOSITION

(75) Inventors: Siegfried Zeuner, München (DE); Roland Schropp, Tegernheim (DE); Achim Hofmann, Polling (DE); Karl-Heinz Rödig, Kraiburg (DE)

(73) Assignee: TRW Airbag Systems GmbH & Co. KG, Aschau Inn (DE)

( * ) Notice: Subject to any disclaimer, the term of this patent is extended or adjusted under 35 U.S.C. 154(b) by 49 days.

(21) Appl. No.: 10/191,229

(22) Filed: Jul. 9, 2002

(65) Prior Publication Data

US 2003/0145926 A1 Aug. 7, 2003

(30) Foreign Application Priority Data

Jul. 10, 2001 (DE) ..... 201 11 410

(51) Int. Cl.[7] ..... C06B 29/02; C06B 29/16
(52) U.S. Cl. ..... 149/77; 149/78
(58) Field of Search ..... 149/77, 78

(56) References Cited

U.S. PATENT DOCUMENTS 5,064,483 A 11/1991 Zeuner
5,482,579 A * 1/1996 Ochi et al. ..... 149/83
5,538,567 A * 7/1996 Henry et al. ..... 149/18
5,739,460 A * 4/1998 Knowlton et al. ..... 280/741
5,747,730 A * 5/1998 Scheffee et al. ..... 149/47
5,756,929 A * 5/1998 Lundstrom et al. ..... 149/77
5,780,768 A * 7/1998 Knowlton et al. ..... 149/78
5,854,442 A * 12/1998 Scheffee et al. ..... 149/18
6,221,187 B1 * 4/2001 Knowlton et al. ..... 149/43
2002/0023699 A1 2/2002 Matsuoka et al.

FOREIGN PATENT DOCUMENTS

DE 4412871 A1 10/1994
WO WO9804507 2/1998

OTHER PUBLICATIONS

An excerpt of the technical book by Köhler and Meyer entitled EXPLOSIVSTOFFE, pp. 5–9, ISBN 3–527–28864–3. This excerpt discloses gas generators for air bags and discloses examples of propellant charges for such gas generators. The document refers to natrium azide and to azide–free propellants.

* cited by examiner

*Primary Examiner*—Aileen Felton
(74) *Attorney, Agent, or Firm*—Tarolli, Sundheim, Convell & Tummino L.L.P.

(57) ABSTRACT

A nitrocellulose-free, gas-generating composition for use in vehicle occupant restraint systems, in particular in a belt tensioner gas generator, substantially consists of at least one nitrogen-containing organic fuel in a proportion of 55 to 70% by weight, an inorganic oxidator in a proportion of 30 to 45% by weight, at least one combustion moderator in a proportion of up to 10% by weight and up to 5% by weight conventional adjuvants and additives, each in relation to the overall weight of the composition. The composition has a pressure exponent of less than 0.35 and a combustion rate at 200 bar of at least 40 mm/s.

20 Claims, No Drawings

NITROCELLULOSE-FREE GAS-GENERATING COMPOSITION

TECHNICAL FIELD

The invention relates to a nitrocellulose-free, gas-generating composition for use in vehicle occupant restraint systems.

BACKGROUND OF THE INVENTION

Propellants based on nitrocellulose show a high combustion rate. For this reason, these propellants are predominantly used in gas generators for belt tensioners. A disadvantage in nitrocellulose propellants is, however, their poor resistance to aging. In addition, these propellants, owing to their extremely negative oxygen balance, release, on burning, large amounts of incompletely oxidized reaction products, in particular carbon monoxide.

U.S. Pat. No. 5,538,567 discloses a gas-generating composition of approximately 55 to 75% by weight guanidine nitrate, approximately 25 to 45% by weight of an oxidator, in particular potassium perchlorate, approximately 0.5 to 5% by weight of a flow improver such as graphite or soot and up to 5% by weight of a binding agent such as calcium resinate. The average particle size of the guanidine nitrate amounts to between approximately 75 and 350 $\mu$m, and the average particle size of the oxidator is between approximately 50 and 200 $\mu$m.

U.S. Pat. No. 5,854,442 describes a gas-generating composition of approximately 30 to 45% by weight potassium perchlorate, between approximately 55 and 70% by weight guanidine nitrate and 1 to 3% by weight cellulose acetate butyrate as binding agent. The particle size of the oxidator is to lie between 15 and 20 $\mu$m.

The compositions described above, owing to their chemical and physical properties, are only suitable for use in driver's or passenger's gas generators.

BRIEF SUMMARY OF THE INVENTION

A general object of the invention is to provide a nitrocellulose-free, gas-generating composition having a high combustion rate and improved readiness to ignite, which can therefore be used in a belt-tensioner gas generator, which compared with the driver's- and passenger's gas generators requires shorter reaction- and function times.

More specifically, it is an object of the invention to provide a composition consisting essentially of a nitrogen-containing organic fuel other than nitrocellulose, an inorganic oxidator and, possibly, a combustion moderator and conventional additive and adjuvant substances, which has combustion characteristics suitable for use in gas generators for belt-tensioning applications.

According to the invention, a nitrocellulose-free, gas-generating composition for use in vehicle occupant restraint systems, in particular in a belt tensioner gas generator, consists essentially of at least one nitrogen-containing organic fuel in a proportion of 55 to 70% by weight, an inorganic oxidator in a proportion of 30 to 45% by weight, at least one combustion moderator in a proportion of up to 10% by weight and up to 5% by weight conventional adjuvants and additives, each in relation to the overall weight of the composition. The composition has a pressure exponent of less than 0.35 and a combustion rate at 200 bar of at least 40 millimeters per second (mm/s).

Such a composition is suitable in particular for use in a belt-tensioner gas generator.

The oxygen balance of the composition preferably amounts to between −5 and +5%. The oxygen balance here means the amount of oxygen in percentage by weight which is released with complete conversion of a compound or of a mixture to $CO_2$, $H_2O$, $Al_2O_3$, $B_2O_3$, etc. (oxygen overbalancing). If the oxygen which is present is not sufficient for this, then the necessary missing quantity for complete conversion is indicated with a minus sign (oxygen underbalancing). Owing to the advantageous oxygen balance of the gas-generating composition according to the invention, the amount of harmful gas occurring on burning, in particular the carbon monoxide proportion, is low.

The organic fuel is preferably a guanidine compound, particularly preferably guanidine nitrate mixed with at least one further compound containing nitrogen, of the group consisting of nitroguanidine, nitrotriazolon (NTO), hexogen (RDX), octogen (HMX), ethylene diamine dinitrate (EDDN), triaminoguanidine nitrate (TAGN), azobisformamidine dinitrate and dinitroammeline. Preferably, the fuel is composed of 75 to 90% by weight guanidine nitrate and 10 to 25% by weight of the further compound, each in relation to the overall weight of the fuel. Particularly preferably, the further compound is nitroguanidine. The further compound containing nitrogen increases the combustion rate in the entire pressure range. An addition of more than 25% of the further compound of course causes too great an increase in the combustion temperature, so that there is a danger of damage to the gas generator. Also, for reasons of cost, the proportion of the further compound is to be kept as small as possible.

The inorganic oxidator is preferably a perchlorate, in particular an alkali metal perchlorate and/or ammonium perchlorate, and particularly preferably potassium perchlorate. As combustion moderators, in particular compounds, containing oxygen, of transition metals, preferably of iron, copper, manganese, titanium, vanadium, molybdenum and chromium, including combinations thereof, can be used. Preferably, the combustion moderator is selected from the group consisting of CuO, $Cu_2O$, $CuCr_2O_4$, $Fe_2O_3$, $3Cu(OH)_2 \times Cu(NO_3)_2$ and mixtures thereof. The combustion moderator CuO is quite particularly preferred.

A use of the combustion moderators described above in a proportion of between 2 and 5% by weight has proved to be advantageous. Higher proportions reduce the gas yield of the propellant, which is not desirable in all cases.

The mean particle size of the combustion moderator is preferably less than 5 $\mu$m and particularly preferably less than 1 $\mu$m, with a preferred specific surface of at least 2 $m^2/g$, particularly preferably at least 5 $m^2/g$. The addition of such fine-grained combustion moderators improves the readiness to ignite of the gas-generating compositions according to the invention, so that ignition delays of a maximum of 6 milliseconds (ms) and particularly preferably of a maximum of 5 ms can be reached.

The mean particle size of the fuel and of the oxidator is preferably less than 15 $\mu$m and particularly preferably less than 10 $\mu$m. This contributes to the gas-generating composition according to the invention having a sufficiently high combustion rate for belt tensioning applications.

With the compositions according to the invention, combustion rates of at least 40 mm/s can be achieved under operating conditions, i.e. usually a pressure of 200 bar. Preferably, the combustion rate at 200 bar amounts to at least 45 mm/s.

The combustion rate is pressure-dependent and can be calculated according to the following equation:

$$r=a\cdot p^n$$

In this equation, r denotes the combustion rate, a denotes a propellant-specific constant, p is the pressure and n is the pressure exponent. If r and n at a particular pressure p are known, the constant a can be determined.

The pressure exponent of the compositions according to the invention is less than 0.35 and preferably less than or equal to 0.3. Higher pressure exponents also cause at low temperatures a poorer readiness to ignite.

The setting of the combustion rate of the compositions according to the invention preferably takes place by selection of the suitable fuel composition, in particular the type and proportion of the further nitrogen-containing compound, the type and proportion of the respective combustion moderator and the average particle size of the fuel, of the oxidator and, possibly, of the combustion moderator. Through a suitable combination of these parameters, the composition can be adapted optimally to use in belt-tensioner gas generators.

The usual adjuvants and additives include processing aids, such as lubricants, pressing aids and flowability aids. As examples of these compounds, in particular calcium stearate, silicon dioxide, graphite or soot can be mentioned. The processing aids are preferably used in a proportion of up to 2% by weight in relation to the overall composition.

A particularly preferred composition according to the invention consists of 48 to 52 parts by weight guanidine nitrate, 13 to 17 parts by weight nitroguanidine, 33 to 37 parts by weight potassium perchlorate, 2.0 to 5.0 parts by weight copper oxide (CuO) and in each case up to 1% by weight calcium stearate and graphite.

Further features and advantages of the invention will be apparent from the following description of particularly preferred embodiments which, however, are not to be understood to be restrictive.

DETAILED DESCRIPTION OF THE PREFERRED EMBODIMENTS

EXAMPLE 1 to 5

Guanidine nitrate with a mean particle size of 5 μm, nitroguanidine with a mean particle size of 11 μm, potassium perchlorate with a mean particle size of 7 μm, copper oxide (CuO) with a mean particle size of 0.5 μm and a specific surface of 8 $m^2/g$ and also calcium stearate and graphite were mixed in the parts by weight indicated in the following Table 1, ground together in a ball mill and compressed into tablets of 6×2.5 mm.

TABLE 1

| Example No. | 1 (Comparative Example) | 2 (Comparative Example) | 3 (Comparative Example) | 4 | 5 |
|---|---|---|---|---|---|
| Guanidine Nitrate | 65 | 57.5 | 50.0 | 50.0 | 50.0 |
| Nitro-Guanidine | 0 | 7.5 | 15.0 | 15.0 | 15.0 |
| $KClO_4$ | 35 | 35.0 | 35.0 | 35.0 | 35.0 |
| CuO | 0 | 0 | 0 | 2.5 | 5.0 |
| Calcium-Stearate | 0.5 | 0.5 | 0.5 | 0.5 | 0.5 |
| Graphite | 0.4 | 0.4 | 0.4 | 0.4 | 0.4 |
| $O_2$-Balance | −3.3% | −3.6% | −4.0% | −3.5% | −3.0% |

The combustion rate of the compositions according to Examples 1 to 5 was determined by firing in each case 10 grams propellant in a closed 100 $cm^3$ tank. The results of the tests and further characteristics of the compositions are shown in Table 2.

TABLE 2

| Example No. | Combustion Rate r at 200 bar [mm/s] | Theoretical Combustion Temperature [K] | Gas Yield (%) | Pressure Exponent n |
|---|---|---|---|---|
| 1 | 30.8 | 2377 | 81.31 | 0.374 |
| 2 | 32.5 | 2419 | 81.32 | 0.387 |
| 3 | 34.7 | 2462 | 81.32 | 0.380 |
| 4 | 42.9 | 2441 | 79.84 | 0.289 |
| 5 | 46.2 | 2438 | 78.44 | 0.242 |

For example 3 an ignition delay of 11 ms was determined; Examples 4 and 5 showed an ignition delay of 6 and 5 ms, respectively.

The composition according to Example 5 in addition underwent an aging test over 400 hours at 107 degrees Celsius. After this test, a weight loss of 0.07% was established, which means the composition showed a resistance to aging which satisfies the requirements of vehicle occupant restraint systems. A comparative test with a conventional propellant on the basis of nitrocellulose under the same conditions produced a weight loss of 14%. This points to a complete decomposition and hence a complete functional failure of the propellant.

The combustion tests described above show the suitability of the compositions according to the invention for use in belt tensioner gas generators. The values achieved for the combustion rate and also the ignition delay correspond, with the use of identical quantities of propellant, to those of conventional nitrocellulose propellants.

What is claimed is:

1. A nitrocellulose-free, gas-generating composition adapted for use in a belt tensioning system, said composition consisting essentially of at least one nitrogen-containing organic fuel in a proportion of 55 to 70% by weight, an inorganic perchlorate oxidator in a proportion of 30 to 45% by weight, at least one combustion moderator in a proportion of between 2 and 5% by weight wherein said combustion moderator is at least one of the oxygen-containing compounds of Fe, Cu, Mn, Ti, V, Mo and Cr, and conventional adjuvants and additives in an amount of between 0 and 5% by weight, each in relation to the overall weight of said composition, wherein said nitrogen-containing organic fuel consists of 75 to 90% by weight of guanidine nitrate in admixture with 10 to 25% by weight of at least one further compound selected from the group consisting of nitroguanidine, nitrotriazolon, hexogen, octogen, ethylene, diamine dinitrate, triaminoguanidine nitrate, azobisformamidine dinitrate, each in relation to the fuel, and said composition having a pressure exponent of less than 0.35 and a combustion rate at 200 bar of at least 40 mm/s.

2. The gas-generating composition according to claim 1, wherein the oxygen balance of said composition is between −5 and +5%.

3. The composition according to claim 1, wherein said fuel consists of 75 to 90% by weight guanidine nitrate and 10 to 25% by weight nitroguanidine, each in relation to the weight of said fuel.

4. The composition according to claim 1, wherein said oxidator is potassium perchlorate.

5. The composition according to claim 1, wherein said combustion moderator is selected from the group consisting of CuO, $Cu_2O$, $CuCr_2O_4$, $Fe_2O_3$, and $3Cu(OH)_2 \times Cu(NO_3)$, $Fe_2O_3$, and $3Cu(OH)_2 \times Cu(NO_3)_2$.

6. The composition according to claim 1, wherein said combustion moderator is CuO.

7. The composition according to claim 1, wherein the main particle size of said fuel and of said oxidator is less than 15 $\mu$m.

8. The composition according to claim 7, wherein the mean particle size of said fuel and of said oxidator is less than 10 $\mu$m.

9. The composition according to claim 1, wherein the mean particle size of said combustion moderator is less than 5 $\mu$m.

10. The composition according to claim 9, wherein the mean particle size of said combustion moderator is less than 1 $\mu$m.

11. The composition according to claim 10, wherein the specific surface of said combustion moderator amounts to at least 2 $m^2/g$.

12. The composition according to claim 11, wherein the specific surface amounts to at least 5 $m^2/g$.

13. The composition according to claim 1, wherein the combustion rate of said composition amounts to at least 45 mm/s.

14. The composition according to claim 1, wherein the pressure exponents is less than or equal to 0.3.

15. The composition according to claim 1, wherein said composition has an ignition delay of a maximum of 6 ms.

16. The composition according to claim 15, wherein the ignition delay amounts to a maximum of 5 ms.

17. The composition according to claim 1, wherein said conventional additives and adjuvants are contained in a proportion of up to 2% by weight.

18. The composition according to claim 1, wherein said conventional additives and adjuvants are selected from the group consisting of calcium stearate, silicon dioxide, graphite and soot.

19. The composition according to claim 1, consisting of 48 to 52 parts by weight guanidine nitrate, 13 to 17 parts by weight nitroguanidine, 33 to 37 parts by weight potassium perchlorate, 2.0 to 5.0 parts by weight CuO and up to two parts by weight of at least one of the compounds selected from the group consisting of calcium stearate, silicon dioxide, graphite and soot.

20. A gas-generating composition for use in belt tensioning systems, said composition consisting of at least one nitrogen-containing organic fuel in a proportion of 55 to 70% by weight, an inorganic perchlorate in a proportion of 30 to 45% by weight, at least one oxygen-containing compound of Cu in a proportion of 2 to 5% by weight and up to 2% by weight conventional adjuvants and additives, each in relation to the overall weight of said composition, wherein said nitrogen-containing fuel consists of 75 to 90% by weight of guanidine nitrate in admixture with 10 to 25% by weight of at least one further compound selected from the group consisting of nitroguanidine, nitrotriazolon, hexogen, octogen, ethylene diamine dinitrate, triaminoguanidine nitrate, azobisformamidine dinitrate, each in relation to the fuel, and wherein said composition has a pressure exponent of less than 0.35 and a combustion rate at 200 bar of at least 40 mm/s.

* * * * *